United States Patent [19]

Murakami et al.

[11] 4,391,587

[45] Jul. 5, 1983

[54] SLAB HEATING FURNACE

[75] Inventors: Tadashi Murakami; Toshikatsu Kishida, both of Himeji, Japan

[73] Assignee: Nippon Steel Corporation, Tokyo, Japan

[21] Appl. No.: 340,673

[22] Filed: Jan. 19, 1982

Related U.S. Application Data

[63] Continuation of Ser. No. 134,577, Mar. 27, 1980, abandoned.

[51] Int. Cl.[3] ..... F27B 9/00; F27D 3/00

[52] U.S. Cl. ..... 432/121; 432/122; 432/234; 432/235

[58] Field of Search ..... 432/233-236, 432/238, 243, 246, 122, 123, 126, 127, 137, 153, 121

[56] References Cited

U.S. PATENT DOCUMENTS

| | | | |
|---|---|---|---|
| 3,214,152 | 10/1965 | Molz | 432/235 |
| 3,345,050 | 10/1967 | Guthrie | 432/236 |
| 3,480,264 | 11/1969 | Krause | 432/235 |
| 3,544,094 | 12/1970 | Knaak | 432/122 |
| 3,637,198 | 1/1972 | Knaak | 432/234 |
| 3,664,649 | 5/1972 | Brockmann | 432/234 |
| 3,749,550 | 7/1973 | Suydam | 432/235 |
| 4,056,351 | 11/1977 | Knaak | 432/235 |

FOREIGN PATENT DOCUMENTS

| | | | |
|---|---|---|---|
| 2705745 | 8/1978 | Fed. Rep. of Germany | 432/235 |

*Primary Examiner*—Henry C. Yuen

*Attorney, Agent, or Firm*—Wenderoth, Lind & Ponack

[57] ABSTRACT

In a slab heating furnace of walking beam- or pusher-type, particularly for the heating of steel prior to the hot working of the steel, skid beams are supported by water-cooled posts. In order to reduce the number of the water-cooled posts from that in the prior art, a post head having a trough shaped portion is stationarily located on each of the posts. The length of the post head is longer than the outer diameter of the post provided with said post head. The total withdrawal of heat from heated steel to all of the post heads is considerably small, because the number of posts is reduced from that of the prior art due to the structure of the post heads. The posts are preferably arranged in a zigzag pattern.

5 Claims, 6 Drawing Figures

SLAB HEATING FURNACE

The present application is a continuation of application Ser. No. 134,577, filed Mar. 27, 1980, now abandoned.

The present invention relates to a heating furnace, particularly a furnace for heating steel prior to the hot working of the steel. The present invention relates more particularly to a walking beam type heating furnace and pusher type heating furnace for heating the steel prior to the hot working of the steel, preferably an electromagnetic steel.

As is well known, while slabs are being introduced into a walking beam type heating furnace, conveyed in the discharging direction of the furnace, and heated to a required temperature for hot working and metallurgy, the steel material is alternately placed on a group of stationary skid beams and a group of movable skid beams. The movable skid beams are moved during one cycle along lifting, forward moving, lowering and returning paths, and forward the slabs in the walking beam type heating furnace. The movable skid beams being lifted engage and lift the slabs being on the stationary skid beams, and when the movable skid beams are lowered, the slabs are again placed on the stationary skid beams. The movable skid beams and stationary skid beams are constructed by welding water cooled metallic skids on water cooled metallic tubes which extend in the longitudinal direction of the furnace, and by covering the entire outer circumference of the water cooled metallic tubes with a refractory material layer. The water cooled, metallic skids are spaced from each other by a predetermined gap. The water cooled metallic tubes are supported by water cooled posts, and these posts are covered by a refractory material and protrude through the hearth of the walking beam type heating furnace. The water cooled posts which suport the stationary skid beams stand vertically on the hearth and are stationary with respect to the hearth, while the water cooled posts which support the movable skid beams protrude through slots in the hearth and are connected to a driving device located below the hearth. The hearth portions through which the posts supporting the movable beams protrude are provided with a bank formed on the hearth around each of these posts, so as to prevent inflow of molten slag or scale into the slots (c.f. Japanese Published Utility Model Applications Nos. 47-2739 and 49-15).

If the molten slag or scale flows into the slots, the lifting, lowering, forward moving and returning movements of the water cooled posts become impossible. Since slabs of electromagnetic steel have a high silicon content and are heated to a high temperature, for example above 1250° C., such slag or scale is dropped from the slabs of the electromagnetic steel. Consequently, the technique of formation of the bank mentioned above is advisable for heating the electromagnetic steel. However, in the conventional walking beam type heating furnaces, there is a problem of stagnation of the molten slag or scale in the space between the banks, which problem is explained hereinbelow in connection with the explanation of the water cooled posts of the conventional walking beam type furnaces.

As is well known, the charging and discharging of slabs, are performed by pushing the slabs from a charging side to the discharging side of the pusher type heating furnace. The heating zone of the furnace is provided with water cooled skid tubes for allowing the conveying and supporting of slabs. In the soaking zone of the pusher type heating furnace the slabs are pushed into contact with the refractory hearth, thereby allowing removal of so called skid marks. The structure of the water cooled metallic tubes, water cooled posts and metallic skids of pusher type heating furances is the same as in the walking beam type heating furnaces. However, no gap is formed between the metallic skids in the pusher type heating furnace, because any gap acts as a resistance during the sliding movement of the steel sections, i.e. the steel slabs.

The number of the above described water cooled posts of the walking beam and pusher type heating furnaces is preferably as small as possible for the following reasons. When the number of water cooled posts is large, and further the heating temperature of the slabs is high, for example, in the heating of electromagnetic steel, fuel consumption must be large enough to compensate for the heat withdrawal by the cooling water in the water cooled posts. When the heat insulating insulation on all of the water cooled posts is increased so as to avoid the high fuel consumption, the installation cost becomes very high. In summary, from the point of view of heating energy, installation and maintainance costs, the number of water cooled posts should be as small as possible.

In the walking beam type heating furnaces, the following special problem arises. Each of the driven water cooled posts of the walking beam type heating furnaces protrudes through the slot mentioned above and a water cooled sealing box is provided below the slot so as to prevent the inflow of the air through the slot into the interior of the walking beam type heating furnaces. The heat withdrawal by the water in the water cooled sealing box is more serious than the heat withdrawal by the cooling water of the water cooled posts.

As is well known, the known water cooled posts of the walking beam and pusher type heating furnaces are tubes which directly support the skid tubes. If the water cooled posts are reduced to a certain number, the load supporting ability of the water cooled posts, is decreased correspondingly to the reduced number. It is believed in the art of slab heating furnaces that the force required for supporting the skid beams is provided by a certain number of the water cooled posts, which number can not be reduced.

Furthermore, in the walking beam type heating furnaces, the distance between a water cooled post and an adjacent bank is small. This is because the number of the water-cooled posts is large as explained above. Stagnation of molten slag or scale occurs in the space between the water cooled post and the banks, with the result that the molten slag or scale overflows the banks into the slots. Accordingly, the walking beam type heating furnaces provided with the banks involve the problem of molten slag or scale stagnation, which should be eliminated.

It is an object of the present invention to reduce the number of water cooled posts supporting water cooled metallic skid tubes constituting the skid beams of heating furnaces as compared to the prior art, the reduction of the number of posts being achieved by the provision of heads of such posts, the shape and structure of these posts being so skillfully designed that the reduction of the number of posts can be achieved even with skid beams having the same cross section as in the prior art.

It is another object of the present invention to cause the molten slag or scale to flow smoothly on the hearth of a walking beam type heating furnace.

It is a further object of the present invention to effectively protect the post heads from a high heat in walking beam pusher type heating furnaces, thereby allowing the post heads to stably support the skid tubes over a long period of time.

It is yet a further object of the present invention to facilitate maintainance of a walking beam type heating furnace and a pusher type heating furnace.

A heating furnace according to the present invention comprises skid tubes or water cooled skid beams and water cooled posts for supporting the water cooled skid beams, wherein a post head having a trough shaped receiving portion for a skid tube is stationarily located on each of the water cooled posts at the upper portion thereof and has a length greater than the outer diameter of the water cooled post provided with said post head.

The present invention is hereinafter explained with regard to embodiments of a walking beam type heating furnace. However, it will be obvious to persons skilled in the art to which the present invention pertains, that the skid beams and the water cooled posts described in these embodiments can be used in pusher type heating furnaces.

The post head is provided with a trough-shaped receiving portion for a skid tube of a water cooled skid beam and a length greater than the outer diameter of the water cooled post.

The skid tubes of the water cooled skid beams are metallic and cooling water flows therethrough. The skid tubes and the water cooled posts constitute continuous beams having a number of fulcrums. In these continuous beams, the bending moment ($M_i$) at each fulcrum is from 1.4 to 2 times the bending moment ($m_i$) at the center between each two fulcrums ($M_i=(1.4\sim2)m_i$). In addition, the cross section of the skid tubes is usually determined by the bending moment ($M_i$) at each fulcrum. The present invention involves the concept of supplementing the force for supporting each of the skid tubes in the proximity of the fulcrums by aid of the strength of each post head. This concept leads to the determination of the cross section of the skid tubes based on the bending moment ($m_i$) at the center between the fulcrums, not by the bending moment ($M_i$) at the fulcrums, with the result that the cross section of the skid tubes can be from 1/1.4 to ½ times that in the prior art. On the other hand, when the cross section of the skid tubes of the present invention is equal to that of the prior art, the moment ($m_i$) and, hence, the distance between the fulcrums according to the present invention, can be larger than in the prior art. Accordingly, it is possible to reduce the number of the water cooled posts as compared to the prior art, because of the trough shaped receiving portion of the post head according to the present invention. When the length (l) of the trough shaped receiving portion is from 2 to 5 times the outer diameter (d) of the water cooled posts, the number of posts can be reduced to one half or less the number of posts having an outer diameter (d) equal to the length (l). The skid tubes and the water cooled posts are provided with a covering of a refractory material resistant to the molten slag or scale on the outer circumference thereof.

In an embodiment of the present invention, each of the skid tubes is mounted on one of the trough shaped receiving portions with a highly heat-conductive material therebetween. The highly heat-conductive material may be compactly provided between the skid tubes and the trough shaped receiving portions. The highly heat-conductive material is used in the present invention for the following reasons. In order to exert the cooling effect of the skid tubes on the post heads, and hence, to protect the post heads by cooling, the skid tubes and the post heads are preferably in contact with each other. The heat conduction between the thus contacted skid tubes and post heads would be high if a metallic contact were provided therebetween. However, it is practically difficult to provide a completely metallic contact between the skid tubes and the post heads due to the accuracy of shaping these tubes and post heads. Minute clearances are, therefore, locally formed between these tubes and post heads, and a heat-insulating layer is unavoidably formed due to gases in the clearances. In order to prevent the formation of the insulating layer, and hence to enhance the thermal conduction between the skid tubes and the post heads, the highly heat-conductive material is placed therebetween. The amount of the highly heat-conductive material placed between the skid tubes and trough shaped receiving portions may be small. It is possible to effectively prevent a strength reduction of the post heads, because the cooling effect of the skid tubes satisfactorily extends to the post heads.

In another embodiment of the present invention, a bracket is rigidly secured to the lower side of each of the skid tubes and extends in the longitudinal direction of the skid tubes, and the post head is connected to the bracket by means of a pin. The skid tubes can be easily exchanged by removing the pin from the bracket and the trough shaped receiving portion and, then, withdrawing the skid tubes from the receiving portion.

In another embodiment of the present invention, the pin securing portion of the post head is in the form of a thin neck and a heat-insulating refractory layer, which is covered by the refractory covering at the outermost part of the water cooled posts, is formed on the neck portion. The thin neck portion is liable to have a structure such that it is difficult to accomodate therein a water cooling system. The structure of neck portion is, therefore, not highly resistant to heat. Since the neck portion is thin, the thickness of the heat-insulating refractory layer is large. The thick and high heat insulating refractory layer can effectively protect the neck portion from high-temperature conditions in the heating furnace.

In another embodiment of the present invention, the water cooled posts are arranged in a zigzag pattern as seen in a plan view. In a walking beam type heating furnace, the water cooled posts, the posts of the stationary skid beams and the posts of the movable skid beams, which are surrounded by banks for preventing the inflow of molten slag or scale, are alternately arranged in a zigzag pattern. In this embodiment, no water cooled posts are positioned between the banks of the walking beam type heating furnace and the distance between a water cooled post and an adjacent bank is large. Consequently, the flowability of the molten slag or scale is considerably increased as compared to the flowability in the conventional walking beam type heating furnaces.

A linear arrangement of the posts in conventional heating furnaces can also be adopted in the furnaces of the present invention. However, when the zigzag arrangement is used in the walking beam type heating furnace as described above, the advantage of a small number of posts as well as an advantage of considerably enhancing the flowability of the molten slag or scale on the hearth are achieved.

Preferred embodiments of the present invention are hereinafter explained with reference to the drawings, wherein.

Figure 1:
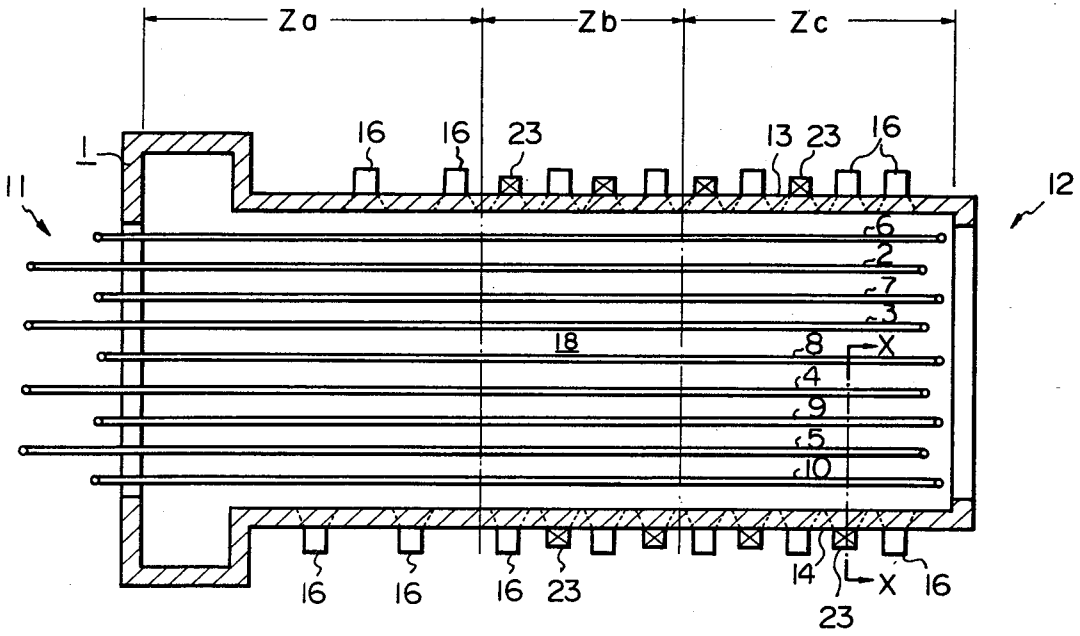
FIG. 1 illustrates an arrangement of skid beams in a conventional walking beam type heating furnace.
Figure 2:
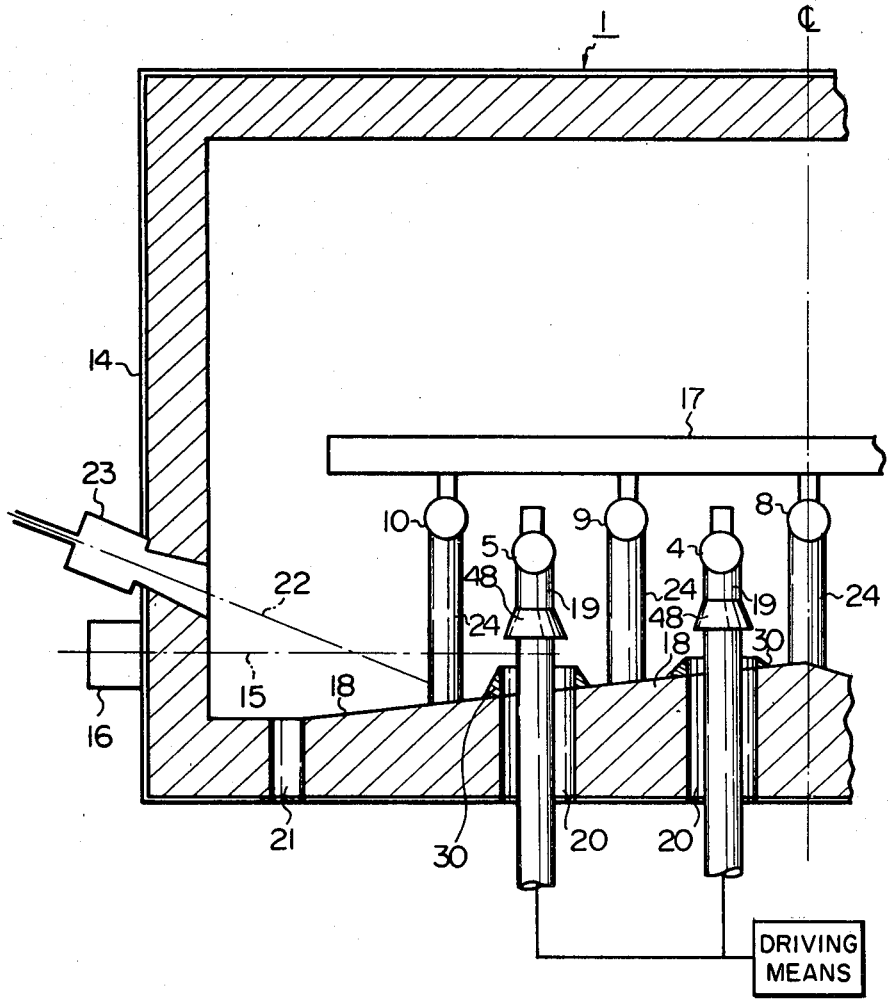
Fig. 2 PRIOR ART
FIG. 2 is a cross sectional view along line X—X in FIG. 1.

In a conventional walking beam type heating furnace 1 illustrated in FIGS. 1 and 2, the movable skid beams 2, 3, 4 and 5, driven by drive means as shown schematically in FIG. 2, and the stationary skid beams 6, 7, 8, 9 and 10 are arranged in parallel and alternately in the furnace 1, and run from a charging opening 11 to a discharging opening 12 of the furnace. Not shown are axial flow burners located on the furnace roof above the beams 1 through 10. Side burners 16 are located on the furnace side walls 13 and 14 below the beams 1 through 10 in such a manner that the axis 15 of the flame is horizontal. The side burners 16 are alternately positioned on the side wall 13 and the side wall 14. The axial flow burners and side burners are arranged in each of a preheating zone Za, a heating zone Zb and a soaking zone Zc.

In the walking beam furnace, particularly one used for a high temperature heating such as in the heating of an electromagnetic steel, the hearth 18 is provided with extracting slots 21 for the molten slag or scale in both borders of the hearth along the side walls 13 and 14. In addition, the hearth 18 has gentle slopes which descend from the top at the center of the hearth to both borders along the side walls 14. The molten slag or scale, which falls from the slab 17 to the hearth 18 is, therefore, caused to flow into the extracting slots 21. Slag or scale melting burners 23 located on the side walls enhance the flowability of the molten slag or scale on the hearth 18. The skid beams 1 through 10 are supported by water cooled posts 19 and 24. A is formed on the heath 18 so as to surround the inner wall of the bank 30 each of the slots 20 through which the water cooled posts 19 for supporting the movable skid beams protrude. The banks 30 prevent the inflow of the molten slag or scale into the slots 20. A beveled body 48 is rigidly secured to each of the water cooled posts 19 and prevents the flow of the molten slag or scale along the posts 19 into the slots 20 and the dropping of the molten slag or scale directly into the slots 20.

Figure 3:
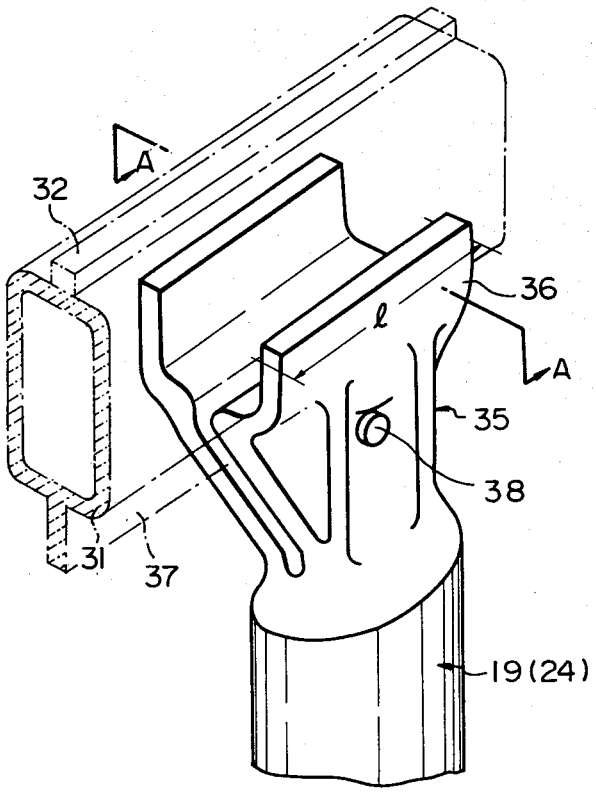
FIG. 3 is a perspective view of top portion of the water cooled posts according to the present invention, with the skid beams in phantom lines, and before the outermost refractory covering has been formed on the beam and post.
Figure 4:
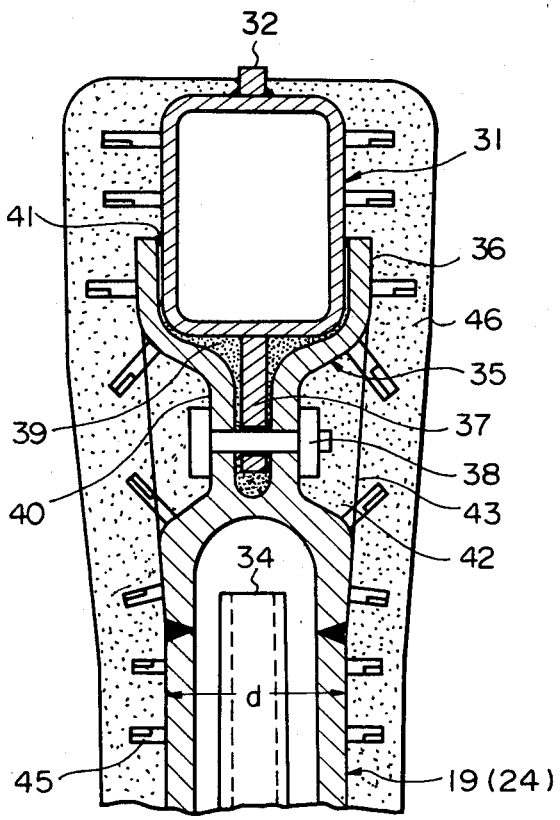
FIG. 4 is a cross sectional view along line A—A in FIG. 3, but with refractory layers formed on the skid beam and the water cooled post.

In FIGS. 3 and 4 the structure of the skid tubes and water cooled posts according to the present invention and which are for use in a furnace such as that in FIGS. 1 and 2 is illustrated in detail. Referring to FIGS. 3 and 4, reference numeral 31 designates a skid tube having a rectangular cross section, and reference numberal 32 designates a skid rail thereon. A core tube 34 is accomodated in a water cooled post, either a moving post 19 or a stationary post 24, to water-cool the post. A metallic post head 35 is provided on the water cooled post 19 or 24 and supports the skid tubes 31. The post head 35 has a trough shaped cross section and the length (l) of the trough shaped post head is greater than the outer diameter (d) of the water cooled posts which are made of metallic tubes. Accordingly, the supporting force of the skid tubes at a fulcrum portion is greater in the supporting system of $l>d$ than in the supporting system of $l=d$ and, therefore, the distance between the fulcrums is shorter in the former supporting system than in the latter supporting system. As an example of the length (l) of the trough shaped post head, the length can be 2.5 times the outer diameter (d), i.e. $l=2.5$ d. With a length according to this example, the number of water cooled posts can be reduced to approximately one half of that in a walking beam type heating furnace where l is equal to d.

Quantitatively speaking with regard to a particular conventional walking beam type heating furnace, the number of stationary skid beams is five and each of the stationary skid beams is supported by sixteen water cooled posts. The total number of the water cooled posts for supporting the stationary skid beams is, therefore, eighty. On the other hand the number of movable skid beams is four and each of the movable skid beams is supported by sixteen water cooled posts which are driven so as to carry out the movement of the movable skid beams. The total number of the driven water cooled posts is, therefore, sixty four.

According to the present invention, the number of water cooled posts necessary for supporting one stationary skid beam of similar capacity in the particular furnace mentioned above can be decreased from the sixteen mentioned above to nine. In addition, the number of water cooled posts for supporting one movable skid beam can be decreased from the sixteen mentioned above to eight. The total number of the water cooled posts can, therefore, be decreased from 144 in the particular conventional walking beam type heating furnace mentioned above to 72 by using the posts according to the present invention.

Returning to FIGS. 3 and 4, a bracket 37 is fixed to the lower surface of the skid tube 31 extending in the longitudinal direction of the skid tube. A trough shaped upper receiving portion 36 is provided on the post head 35 contiguous to a lower neck portion 40 thereof. The bracket 37 is secured to the post head by a pin connection 38 constituted by a positioning pin and a nut. Since the pin and nut are removable, the skid tubes 31 can be easily disassembled from the post head, if necessary.

A highly heat-conductive material 39, for example SiC, fills the space between the skid tube 31 and the inner surface of the post head 35. The skid tube 31 is welded to the circumference of trough shaped receiving portion 36 by a weld 41.

A cooling effect of the skid tube 31 and water cooled post 19 or 24 extends to the post head 40. However, the cooling effect extending from the skid tube 31 and the water cooled post 19 or 24 is least at the thin neck portion 40. Therefore, when the thin neck portion 40 is subjected to an external high temperature it is likely to lose its weight supporting ability due to buckling. Consequently, a thick refractory layer 42, which is highly heat-insulating, is formed on the neck portion 40. The refractory layer 42 may be ceramic fiber layers. Stainless sheets 43 are applied on the outside of the refractory layer 42.

Stud pins 45 shown in FIG. 4 are rigidly secured to the water cooled posts 19 and 24 and the skid tubes 31. A refractory layer 46 covers all of the parts of the skid tubes and the water cooled posts, so as to protect these members from the molten slag or scale which is generated by the melting of scale from the material being heated. The material of the refractory layer 46 is selected from such materials as ceramic refractories which are not eroded by the molten slag or scale.

As will be understood from the explanation with reference to FIGS. 3 and 4, the water cooled posts according to the present invention greatly contribute to the operation of a walking beam type heating furnace and reduction of the heat loss as compared with the prior art, because the load supporting system is improved by greatly increasing the distance between the fulcrums as compared with the prior art.

Figure 5:
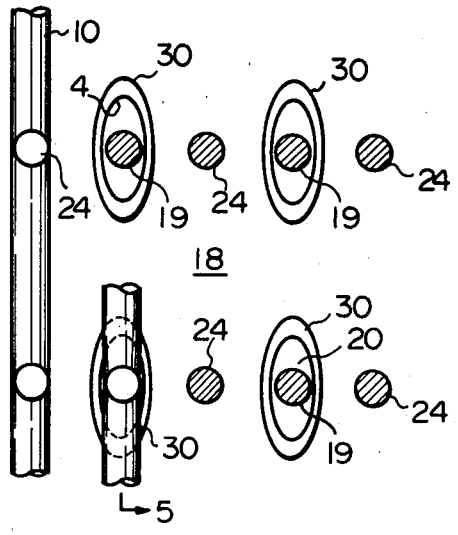
FIG. 5 is a plan view illustrating an arrangement of the water cooled posts for the stationary skid beams and banks.
Figure 6:
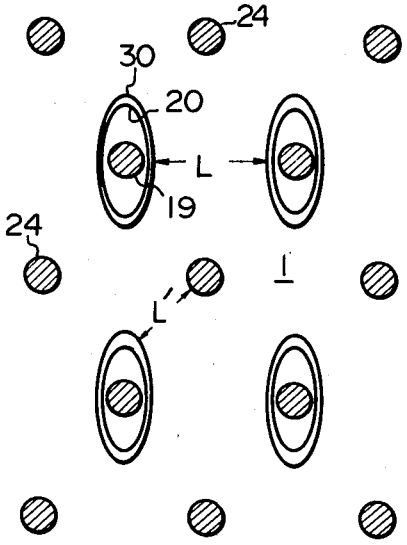
FIG. 6 is a view similar to FIG. 5.

As seen in the plan view of FIG. 6, the banks 30 and the posts 24 of the stationary skid beams are arranged in a zagzag pattern transversely of the beams, i.e. the transverse rows of stationary posts alternate with transverse rows of movable posts, while the conventional skid beam arrangement of posts is linear, i.e. the stationary posts and movable posts alternate with the transverse rows, as seen in FIG. 5. Referring to FIG. 6, there are no water cooled posts between the adjacent banks 30 and, therefore, the free space therebetween having a dimension (L) is large as compared with the free space in the arrangement in FIG. 5. In addition, the free space between an adjacent post and bank having a dimension (L'), is also large. As a result of this large free space, the flowability of molten slag or scale on the hearth is considerably enhanced, and therefore, the flow of molten slag or scale into the slots 20 due to the stagnation of molten slag or scale on the hearth is not likely to occur.

When the water cooled posts the movable skid beams are extremely difficult to drive for the required conveying of steel sections due to the inflow of molten slag or scale into the slots, the operation of the furnace must be interrupted so as to remove the molten slag or scale from the furnace. According to the present invention, particularly the embodiment illustrated in FIG. 6, the number of such interruptions of the operation of the furnace is low. Consequently, compared to the prior art, with the present invention, the heat loss due to interruption of the furnace operation is low, and hence, the cooling of the furnace is decreased. As a result, the amount of fuel necessary to heat the steel is less than with the prior art and, in addition, the maintainance cost involved in the remove of the molten slag or scale from the furnace is low.

What is claimed is:

1. In a heating furnace, the combination of water cooled tubular skid beams, water cooled posts for supporting said water cooled skid beams, and a post head on the upper end of each supporting post and having a trough-shaped receiving portion receiving a skid beam therein, said trough-shaped receiving portion having a length in the direction of the length of the supported skid beam from two to five times the outer diameter of said water cooled posts.

2. The combination as claimed in claim 1 further comprising a highly heat-conductive material filling the space between each of said skid beams and the corresponding trough-shaped receiving portions.

3. The combination as claimed in claim 1 or 2 in which each of said trough-shaped receiving portions has a thin neck portion by which said trough-shaped portion is mounted on the corresponding post, a pin securing said neck to said post, and a highly heat insulating refractory material covering said neck portion and said pin.

4. The combintion as claimed in claim 1 in which some of the skid beams and the water cooled posts supporting them are stationary and the remainder are movable vertically relative to the stationary skid beams and water cooled posts, the water cooled posts for the stationary skid beams being aligned in rows transversely of the length of the skid beams, and the water cooled posts for the movable skid beams being aligned in rows transversely of the length of the skid beams, the rows of the fixed posts alternately with the rows of movable posts.

5. A walking beam type heating furnace having a hearth and stationary water cooled skid beams and movable water cooled skid beams, said stationary water cooled skid beams and said movable water cooled skid beams extending in the longitudinal direction of said furnace and alternately provided in a direction transversely of the furnace, a group of stationary water cooled posts standing on the hearth of said furnace and supporting said stationary water cooled skid beams, said hearth having slots therein, a group of vertically driven water cooled posts protruding through said slots in said hearth and supporting said movable water cooled skid beams, a bank surrounding each of said slots and positioned on said hearth for preventing molten slag or scale from flowing into said slots, a trough-shaped receiving portion on the upper end of each of said posts receiving a skid beam therein, said trough-shaped receiving portions each having a length in the direction of the length of the supported skid beam from two to five times the outer diameter of the post, and the stationary water cooled posts being aligned in rows transversely of the furnace and the vertically driven water cooled posts being aligned in rows transversely of the furnace with the rows of stationary posts alternately with the rows of vertically driven posts.

* * * * *